US006059110A

United States Patent [19]

Tseng

[11] Patent Number: 6,059,110

[45] Date of Patent: May 9, 2000

[54] PACKAGE FOR ORNAMENTAL LIGHT BULBS

[76] Inventor: Jeou-Nan Tseng, No. 539, Sec. 4, Chunghua Rd., Hsinchu, Taiwan

[21] Appl. No.: 09/249,381

[22] Filed: Feb. 12, 1999

[51] Int. Cl.[7] ..... B65D 85/42

[52] U.S. Cl. ..... 206/420; 206/485

[58] Field of Search ..... 206/418, 419, 206/420, 485, 486, 775, 779

[56] References Cited

U.S. PATENT DOCUMENTS 3,136,410 6/1964 Sanford ..... 206/419

5,222,602 6/1993 Liao ..... 206/420

*Primary Examiner*—Jacob K. Ackun

*Attorney, Agent, or Firm*—William E. Pelton, Esq.

[57] ABSTRACT

The present invention relates to a package for Ornamental light bulbs, particularly having one upper board and a lower board parallel to the upper board provided therein. The package is square or rectangular-shaped with three sidewalls with an open grid and one open side. Wherein the upper board defines a series of grooves and the lower board defines a series of grooves corresponding to the grooves of the upper board. The bulbs may be arranged in the groove of the upper board, and the bulb holders are arranged in the groove of the lower board. The spaces under the lower board are positioned to receive the wires and strings of the bulbs.

9 Claims, 8 Drawing Sheets

PACKAGE FOR ORNAMENTAL LIGHT BULBS

BACKGROUND OF THE INVENTION

1. Field of the Invention

The present invention relates to a package, and more particularly to a package specially adapted to systematically receive ornamental light bulbs.

2. Description of Related Art

Ornamental light bulbs are very popular especially during holidays. Manufactures constantly introduce various new types of strings of bulbs in different shapes.

For easy packing, transportation and display of the ornamental bulbs, the strings of bulbs are normally placed on an adapted frame and packed in a paper box. Therefore, merchants can easily display the strings of bulbs to clients. As shown in FIG. 8, a string configuration for a string of bulbs structure is shown wherein the string for the bulbs is a net, which can be hung directly on a wall or roof. Sockets (96) of the bulbs (94) are electrically connected by wires (90). To reinforce the strength of the ornamental light bulb, a metal wire (92) is used to support the wire (90). However, because of the unique structure of this string configuration of ornamental bulbs, they cannot be boxed properly and checked easily. Normally, ornamental light bulbs of this kind put on a reel and packaged in a box, so it is not easy for a person to check whether there are any defective bulbs (94) or to display to customers, because when the ornamental light bulb net is displayed, it will expand up to 10 square meters (10 $m^2$).

An improved package for the net configuration of ornamental light bulbs is necessary to overcome the defects of conventional packing methods.

SUMMARY OF THE INVENTION

The main object of the present invention is to provide an improved package for the ornamental light bulbs. The package is square-shaped with an upper and a lower board parallel to the upper board. Particularly, a series of grooves are defined in the upper board and a series of grooves are correspondingly defined in the lower board. The bulbs are received in the grooves of the upper board, and the wires and a plug are received in a space under the lower board. In such a way, the bulbs are systematically received in the package with the bulbs protruding above the upper board. The bulbs are then arranged in a way convenient to be checked by operators to see if there are any defects.

The detailed features of the present invention will become more apparent from the following detailed description with appropriate reference to the accompanying drawings.

DETAILED DESCRIPTION OF PREFERRED EMBODIMENT

Figure 1:
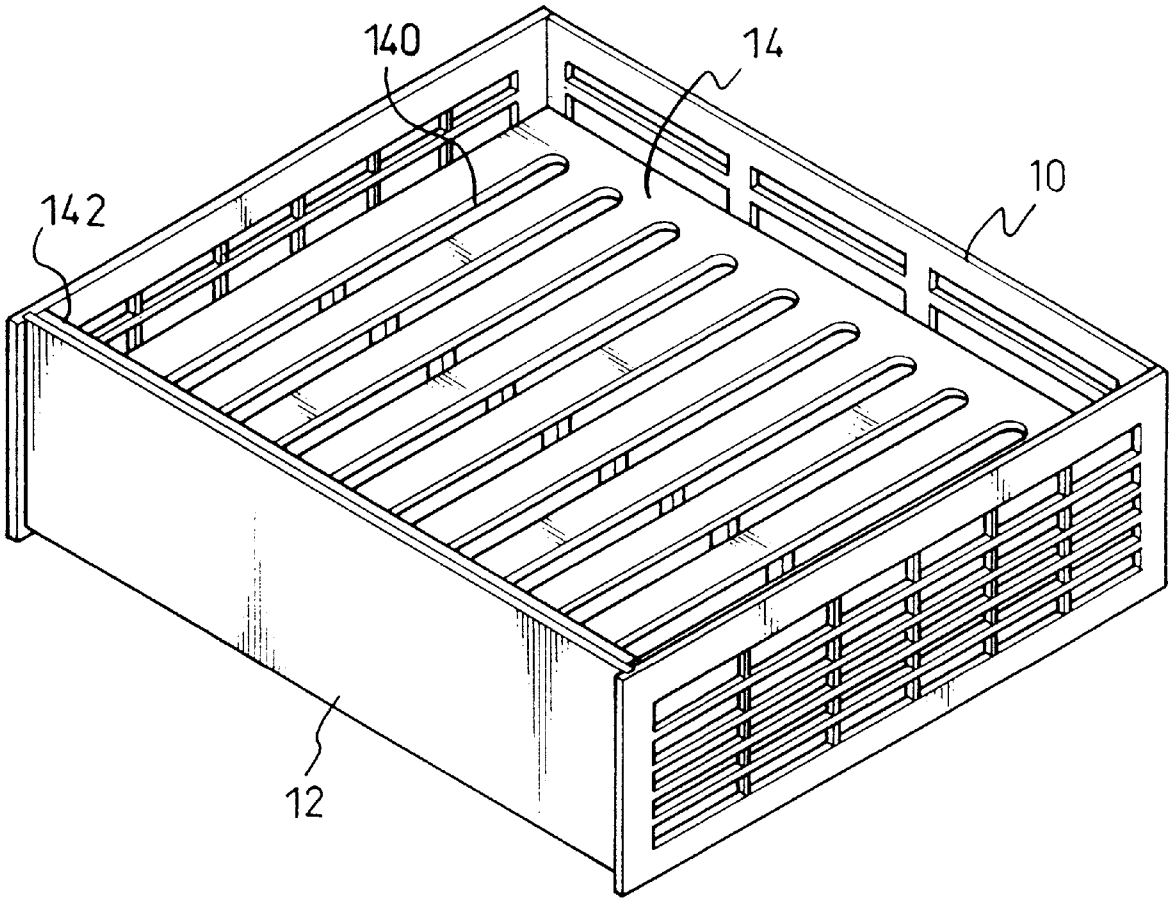
FIG. 1 is a perspective view of a package constructed in accordance with the present invention.
Figure 3:
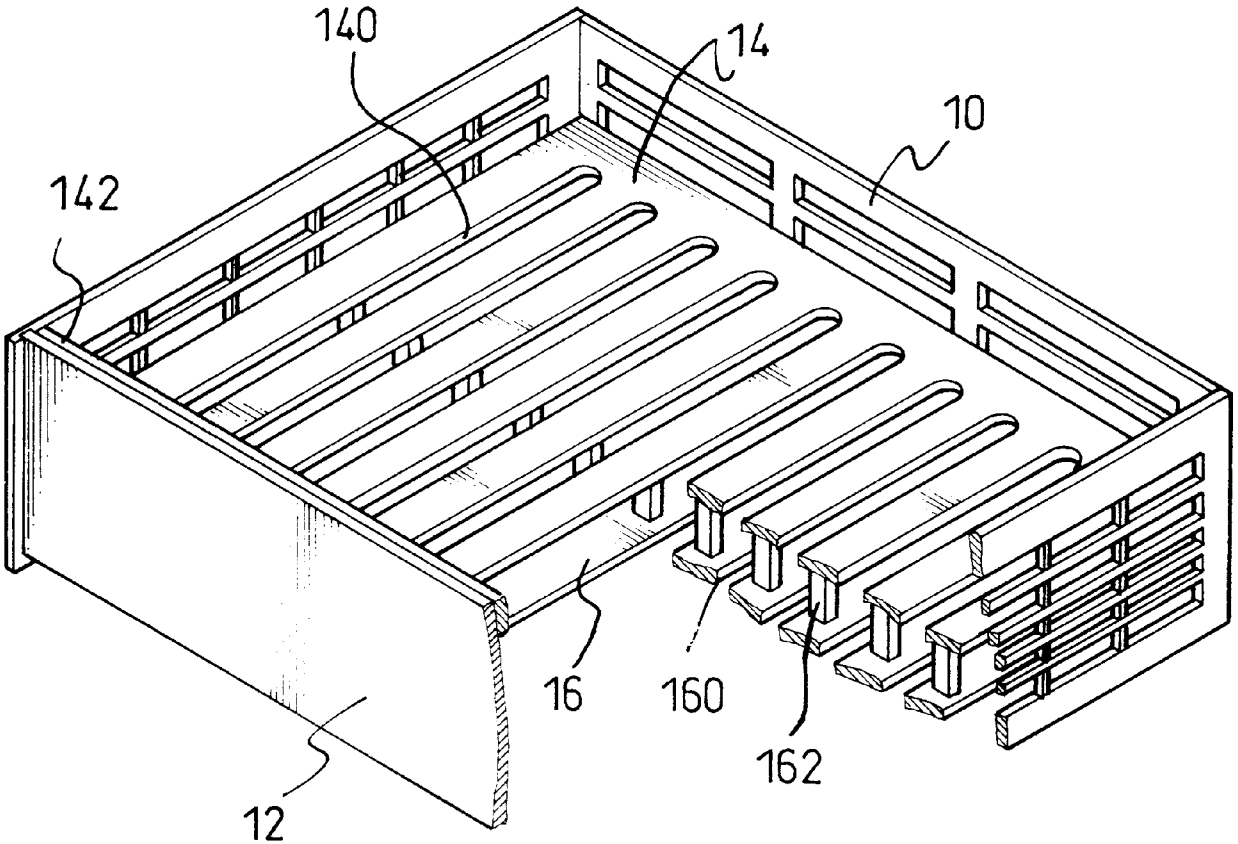
FIG. 3 is a perspective view in partial section of the embodiment in FIG. 1.

As shown in FIG. 1, the present invention relates to a square or rectangular package for packing ornamental light bulbs. The package has three grid-shaped sidewalls (10) and one open side. A slidable end plate (12) is provided at the open side for closing the opening. As shown in FIG. 3, an upper board (14) and a lower board (16) parallel to the upper board (14) are enclosed by the side walls (10).

Figure 2:
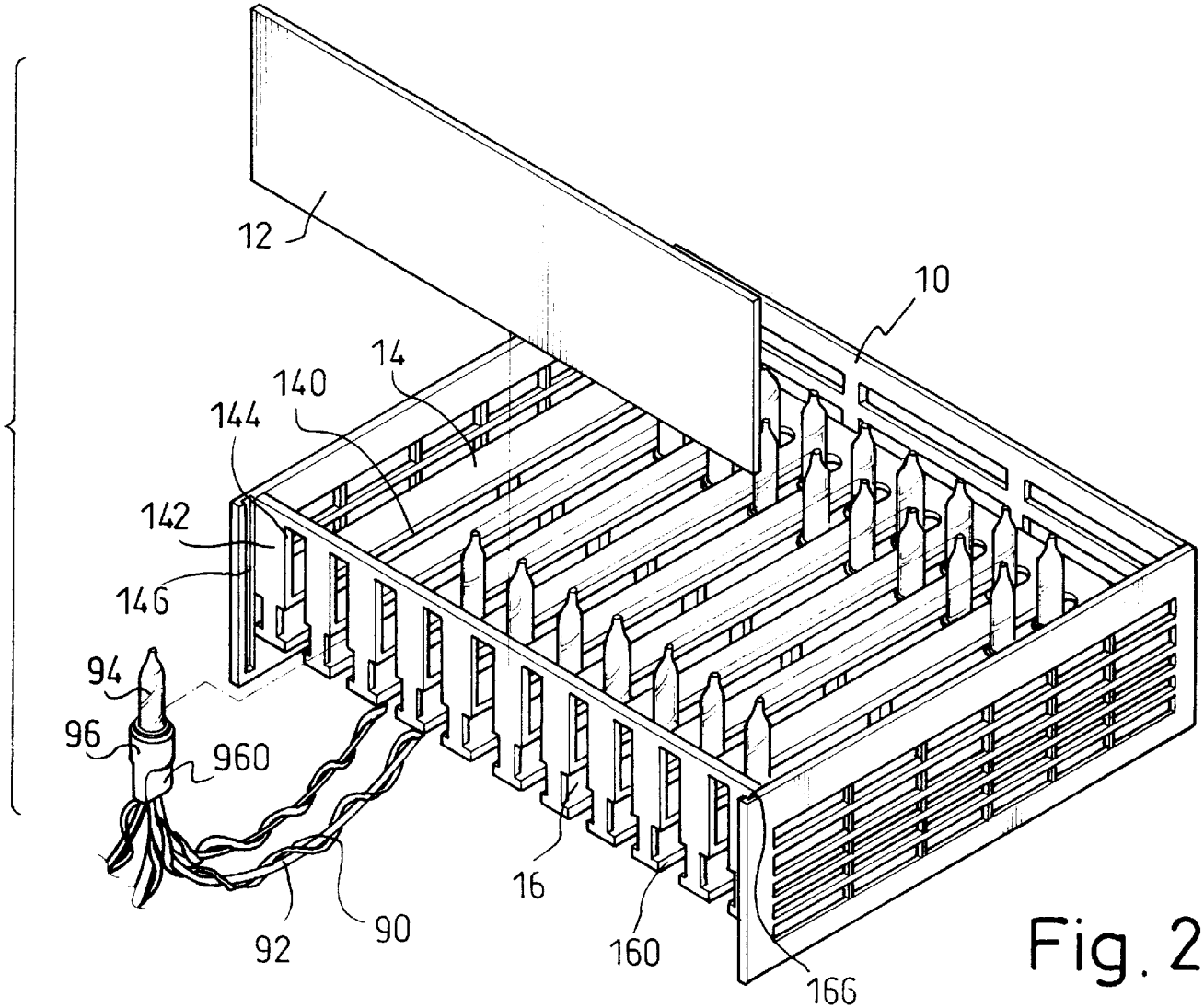
FIG. 2 is an exploded perspective view of the package in FIG. 1 showing a plurality of ornamental light bulbs systematically received within the package.

As shown in FIGS. 2 and 3 with reference to FIG. 1, a series of grooves (140) are defined in the upper board (14), and a series of grooves (160) are defined in the lower board (16) with each corresponding to one of the grooves (140) of the upper board (14). A reinforced plate (142) provided at the open side of the package is integrally formed with the upper and lower boards (14, 16), and defines a series of entrance openings (144) respectively communicating to each one of the grooves (140, 160). A groove (146, 166) is defined in the side of the side walls (10) near the opening hold the end plate (12) therein.

The end plate (12) is removed from the grooves (146, 166) to expose the entrance openings (144). Then, the bulbs (94) can be inserted through the entrance opening (144) and properly arranged in the grooves (140) of the upper board (14), and the waist (960) of the socket (96) can be inserted through the entrance opening (144) and properly arranged in the lower groove (160). Electrical wires (90), metal wires (92) connected to the lower end of the socket (96) and a plug (not shown in the figures) are therefore received in a space under the lower board (16). After finishing packing, the end plate (12) can be inserted into the tracks (146, 166) to close the open end of the package of the invention.

More particularly, as shown in FIG. 3, a reinforced rib (162) is provided between each corresponding upper and lower boards (14, 16) to reinforce the positioning of the upper and lower boards (14, 16).

Figure 4:
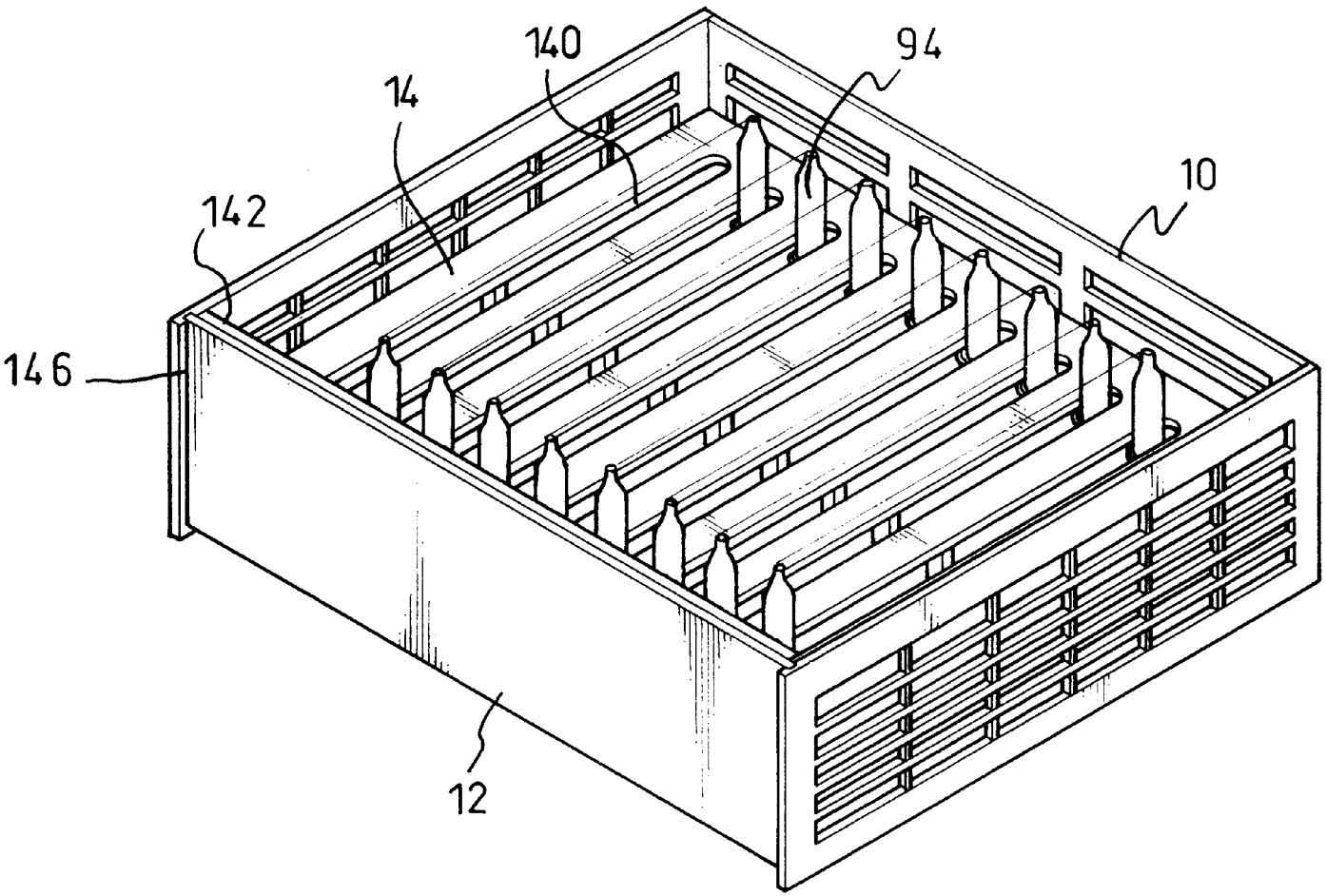
FIG. 4 is a perspective view of the embodiment in FIG. 1 showing a plurality of ornamental light bulbs packed in the package of FIG. 1.

FIG. 4 shows that the bulbs (94) are systematically arranged in the package, and when an operator switches on the power, it is very easy to check for defective bulbs. Since the side walls (10) and the end plate (12) above the upper board (14) are designed to be higher than that of the bulbs (94), after the ornamental light bulbs are fully received in the package, the bulbs (94) will not be pressed and damaged by external forces. In such a way, the quality of the bulbs (94) is ensured during packing, storage and transportation, etc.

Figure 5:
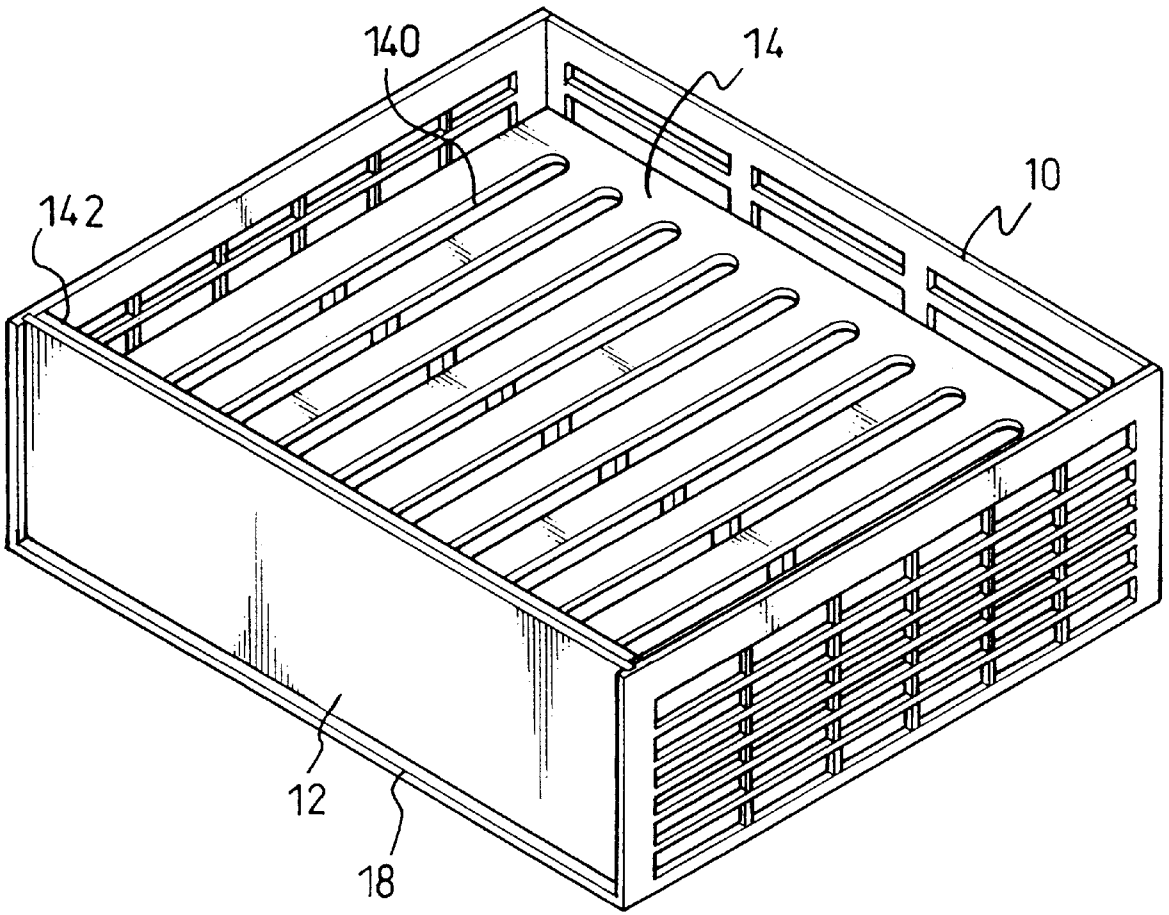
FIG. 5 is a perspective view showing another embodiment of the invention, wherein a bottom board is provided as part of the package of FIG. 1.

FIG. 5 shows another embodiment of the present invention. A bottom board (18) is provided at the bottom of the side walls (10) of the package. The electrical wires (90) and metal wires (92) can be received between the lower board (16) and the bottom board (18).

Figure 6:
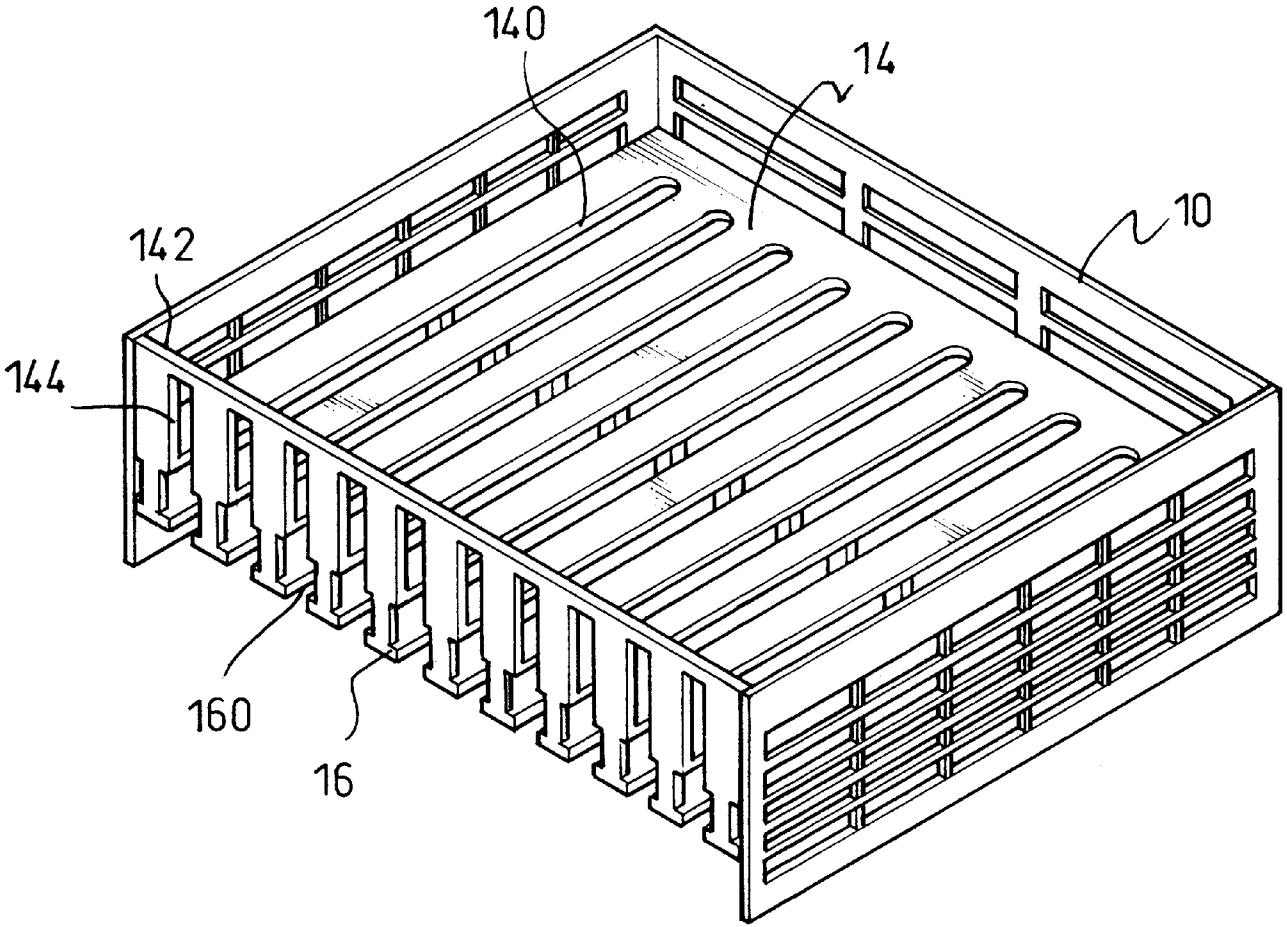
FIG. 6 is a perspective view of still another embodiment, wherein the end plate is removed.

FIG. 6 shows yet another embodiment of the present invention. The reinforced plate (142) of the package is provided at the opening of the package, such that the use of the end plate (12) is unnecessary, which reduces the waste of material and the cost of producing the package.

Figure 7:
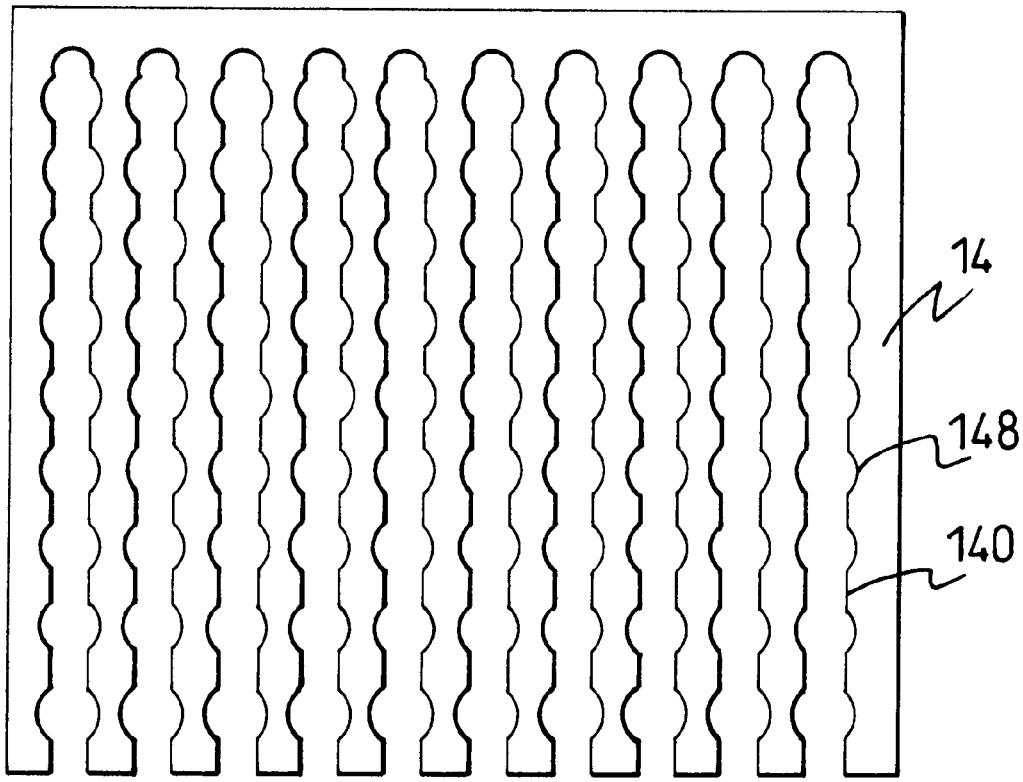
FIG. 7 is a plan view of the upper board of one embodiment of the present invention.
Figure 8:
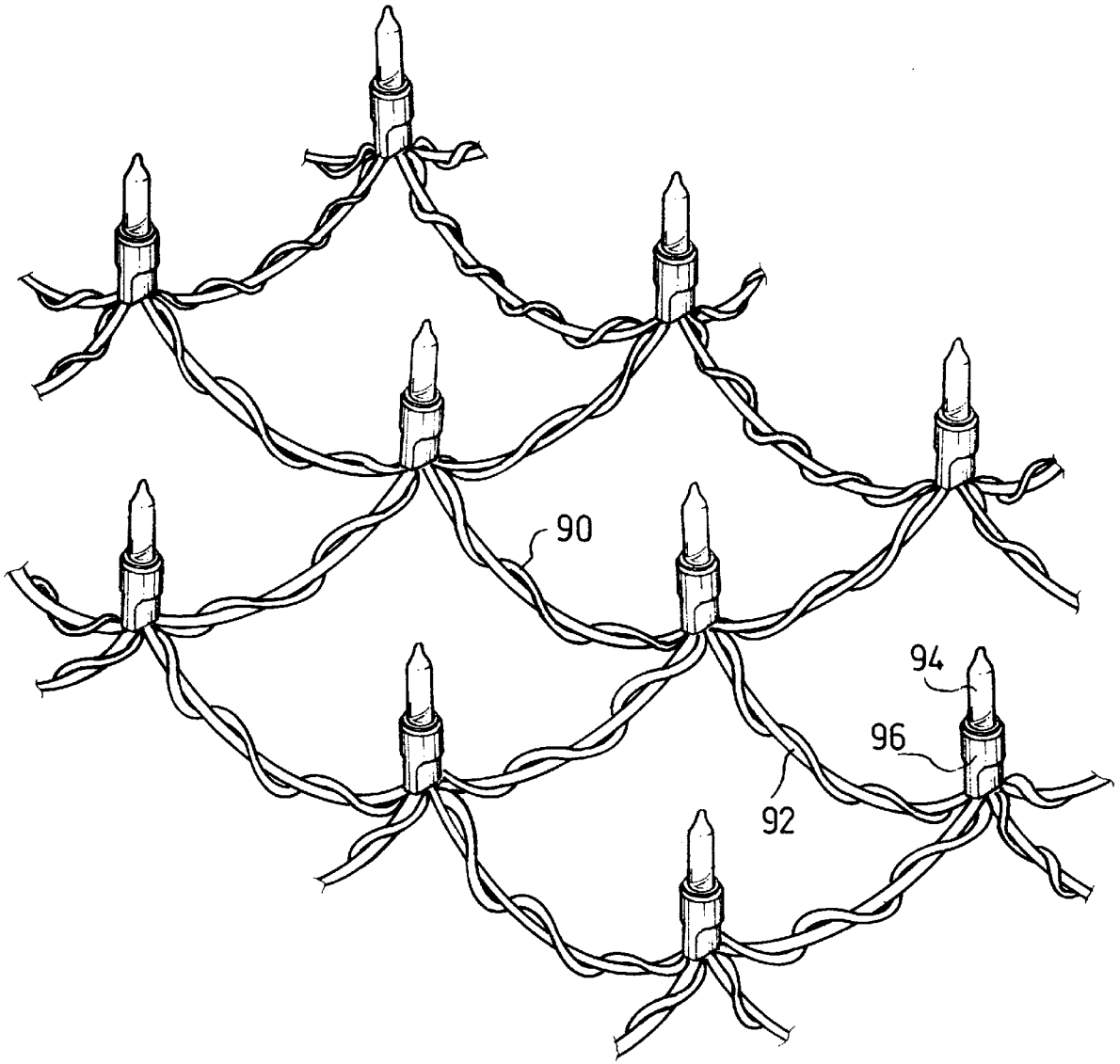
FIG. 8 is a perspective view of a conventional net structure of ornamental light bulbs.

A further embodiment of the present invention is shown in FIG. 7, the grooves (140) of the upper board (14) each have a plurality of recesses (148) defined in the face defining the grooves (140) for respectively receiving one of the bulbs (94) therein. The bulbs (94) received in this groove (140) are then positioned more precisely.

The above-described embodiments are adapted to packing all kinds of strings of bulbs conveniently and systematically. The fabrication of the package can be accomplished by integral casting, assemblage, agglutination, etc.

What is claimed is:

1. A package for ornamental light bulbs, wherein the package is square or rectangular-shaped with three side walls and one open side;

an upper board and a lower board parallel to the upper board are provided in the container;

a series of grooves are defined in the upper board, and a series of corresponding grooves are defined in the lower board.

2. A package for ornamental light bulbs as claimed in claim 1, wherein two slide grooves are respectively defined in the opposite internal sides of the opening for slidable holding the end plate therein.

3. A package for ornamental light bulbs as claimed in claim 2, wherein a reinforced plate is integrally formed with the upper and lower boards at the open side, and a series of entrance openings are defined in the reinforced plate respectively communicating with the grooves of the upper and lower boards.

4. A package for ornamental light bulbs as claimed in claim 3, wherein the side walls have an open grid.

5. A package for ornamental light bulbs as claimed in claim 3, wherein the grooves of the upper board are wide enough to receive the bulbs, and the grooves of the lower board are wide enough to receive the waist of the socket.

6. A package for ornamental light bulbs as claimed 1, wherein the spaces between the boards and under the lower board are in a position to receive wires, strings and a plug of the bulbs respectively.

7. A package for ornamental light bulbs as claimed in claim 5, wherein the sidewalls and the end plate above the upper board are higher than the bulb.

8. A package for ornamental light bulbs as claimed in claim 1, wherein a bottom plate is provided at the bottom end of the sidewalls of the container.

9. A package for ornamental light bulbs as claimed in 5, wherein the grooves of the upper board define a series of recesses for receiving the bulbs therein.

* * * * *